United States Patent [19]

Swan

[11] 4,251,021

[45] Feb. 17, 1981

[54] LID FOR POLYGONAL CONTAINER

[76] Inventor: Walter B. Swan, 7030 W. 100th St., Chicago Ridge, Ill. 60415

[21] Appl. No.: 75,211

[22] Filed: Sep. 13, 1979

Related U.S. Application Data

[63] Continuation-in-part of Ser. No. 959,844, Nov. 13, 1978, abandoned.

[51] Int. Cl.[3] ..... B65D 5/12; B65D 5/32; B65D 13/04

[52] U.S. Cl. ..... 229/43; 229/23 BT; 229/34 R; 229/41 C

[58] Field of Search ..... 229/23 BT, 34 R, 41 C, 229/43

[56] References Cited

U.S. PATENT DOCUMENTS

| | | | |
|---|---|---|---|
| 2,372,312 | 3/1945 | Buttery | 229/41 C UX |
| 2,565,188 | 8/1951 | Welshenbach | 229/41 C X |
| 3,122,298 | 2/1964 | Seger, Jr. | 229/41 C X |
| 3,261,533 | 7/1966 | Repking | 229/23 BT |
| 3,877,631 | 4/1975 | Lai et al. | 229/23 BT X |
| 3,883,067 | 5/1975 | McClynn et al. | 229/34 R X |
| 4,015,767 | 4/1977 | Ferriter | 229/41 C X |
| 4,099,612 | 7/1978 | Hanson | 229/23 BT X |
| 4,134,531 | 1/1979 | Martinez | 229/23 BT |
| 4,136,817 | 1/1979 | Perry | 229/34 R X |

*Primary Examiner*—Davis T. Moorhead

*Attorney, Agent, or Firm*—Robert M. Ward

[57] ABSTRACT

In one preferred embodiment, a lid for a polygonal container, such lid having a polygonal top panel corresponding in shape and size to the opening at the top of the polygonal container, such top panel hingedly connected to a plurality of lid side panels at each of the sides of the polygonal top panel, each lid side panel disposable downwardly to abut the lid side panels in substantially contacting relationship at the edge portions thereof, each lid side panel having a securement panel hingedly connected at the lower edge thereof, and a plurality of locking panels hingedly connected to the lid side panels and having a locking protrusion at the upper edge thereof for engaging with the securement panel of the lid side panel.

In alternative preferred embodiments, such lid has a pair of supplementary polygonal top panels which are hingedly connected at opposing sides of the polygonal top panel, with the lid side panels being hingedly disposed in some embodiments from the supplementary polygonal top panels, or in other embodiments from both the supplementary top panels and the polygonal top panel.

In embodiments where the lid side panels are disposed from the supplementary polygonal top panels, the securement panels may alternatively be disposed exterior of the locking panels.

39 Claims, 14 Drawing Figures

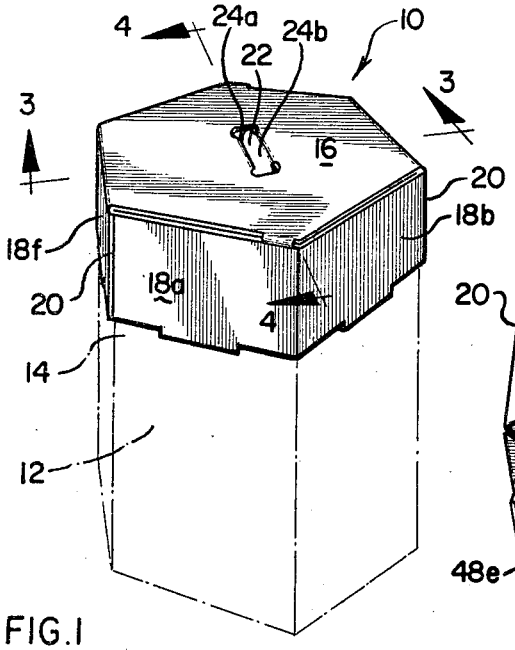
FIG.1
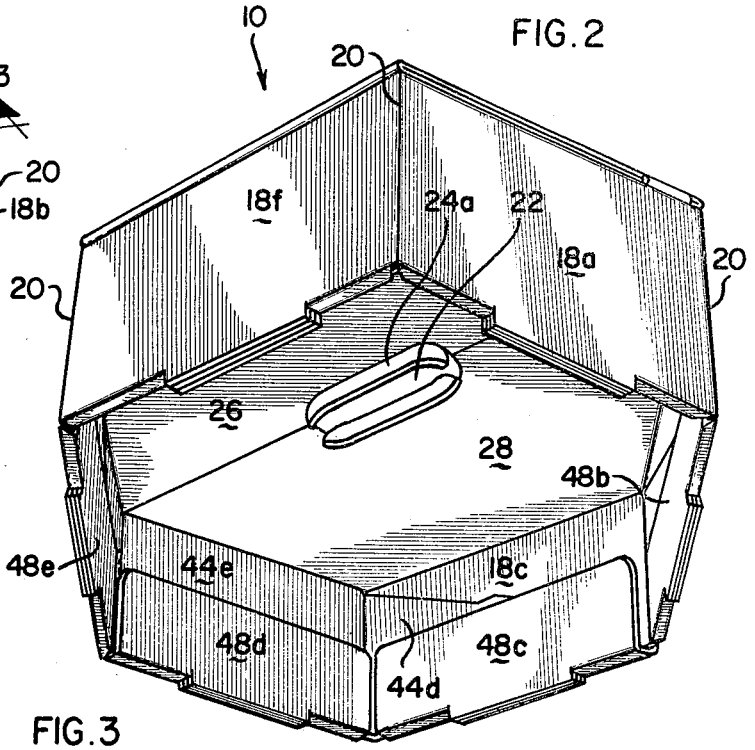
FIG.2
FIG.3
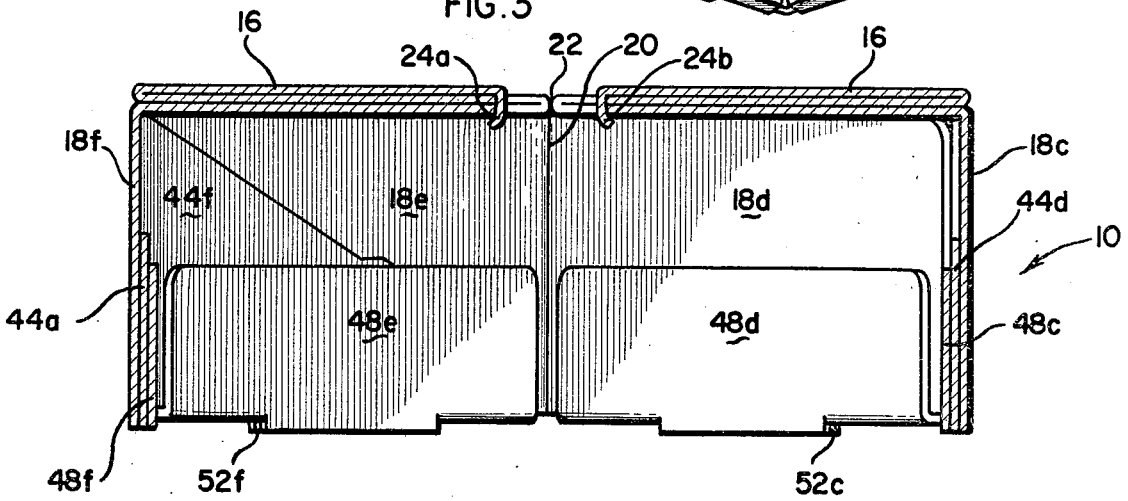
FIG.4
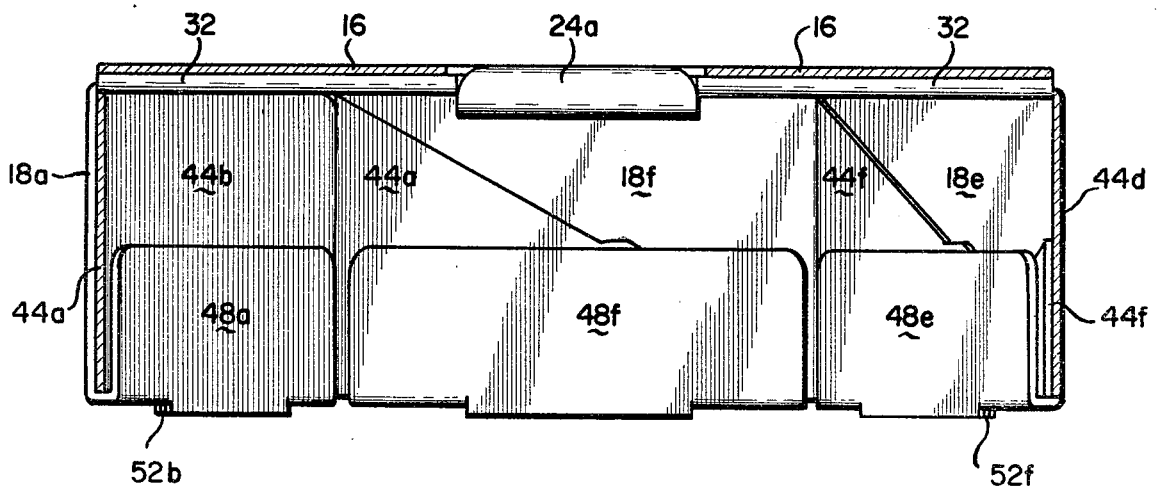

LID FOR POLYGONAL CONTAINER

BACKGROUND OF THE INVENTION

This application is a continuation-in-part application of application Ser. No. 959,844, filed on Nov. 5, 1978, now abandoned.

The present invention relates generally to polygonal containers, and more particularly to a lid for a polygonal container, the lid having a polygonal top panel generally of the same size and shape as the opening in the top of the polygonal container, a plurality of lid side panels hingedly connected to the sides of the polygonal top panel, and a plurality of locking panels hingedly connected to an edge of each lid side panel for interlocking the respective lid side panels to form a strong and stable lid structure.

In the prior art various lids for polygonal containers have been proposed for covering the opening at the top of a polygonal container. A variety of various materials, including paperboard, fiberboard, and the various corrugated materials, have been proposed for such uses. Such prior art lids for prior art containers have been acceptable at times for various specific types of usages. However, many such lids have been less than optimal for other applications, and especially in terms of their want of ease of application, strength and versatility of use.

In view of the above difficulties associated with the prior art, it is an object of the lid for a polygonal container of the present invention to provide a lid having improved ease of fabrication.

It is also an object of the lid for a polygonal container of the present invention to provide a lid adapted for wide versatility of use.

It is an additional object of the lid for a polygonal container of the present invention to provide a lid which may be easily fabricated from a single sheet of material.

It is a further object of the lid for a polygonal container of the present invention to provide a lid which may be formed from a unitary sheet of corrugated material and which may be easily and stably interlocked with the side panels thereof for increased strength and stability.

It is another object of the lid for a polygonal container of the present invention to provide a top panel having a reinforced structure for increased strength and stability.

It is yet another object of the lid for a polygonal container of the present invention to provide a lid structure wherein the multiple layer polygonal top panel thereof is secured and interlocked downwardly by means of the unitary structure thereof.

It is a yet further additional object of the lid for a polygonal container of the present invention to provide in some embodiments a lid structure the sides of which may be disposed into the top opening of the polygonal container to present an unencumbered container side profile for increased space saving in storage.

These and other objects and advantages of the lid for a polygonal container of the present invention will become apparent to one of ordinary skill in the art in view of the following specification.

SUMMARY OF THE PRESENT INVENTION

In the lid for a polygonal container of the present invention, there is provided in one preferred embodiment a lid having a polygonal top panel which corresponds in size and shape to the opening in the top of the polygonal container to be covered. In an alternative preferred embodiment, a pair of supplementary top panels may be hingedly disposed on the polygonal top panel at the sides thereof, which supplementary polygonal top panels may be folded onto preferably the under side of the top panel for disposition thereunder for reinforcement thereof. A plurality of lid side panels are disposed from the polygonal top panel in one preferred embodiment and from supplementary polygonal top panels or the supplementary polygonal top panels and the polygonal top panel in an alternative preferred embodiment, to extend downwardly therefrom to cover at least a portion of the sides of the polygonal container.

In such preferred embodiments, a plurality of locking panels are disposed from a side of each lid side panel, the top edge of the locking panels being generally congruent with the upper edge of the adjacent lid side panel when the lid is in folded disposition. In such folded disposition the lid side panels are disposed at approximately 90° to the polygonal top panel and the edge portions of the lid side panels are in substantially contacting relationship.

Each lid side panel preferably includes a securement panel for folding over the corresponding locking panel. In preferred embodiments where the lid side panels are disposed from the supplementary polygonal top panels, the securement panels may be alternatively folded over and disposed exterior of or interior of the locking panels.

BRIEF DESCRIPTION OF THE DRAWING

FIG. 1 is a perspective view of the lid for a polygonal container of the present invention, showing one preferred embodiment of the lid disposed atop a polygonal container, which is shown in phantom lines;

FIG. 2 is an enlarged perspective view from the underside of the embodiment of the lid for a polygonal container of the present invention as shown in FIG. 1, and showing the supplementary top panels, the plurality of lid side panels, the plurality of locking panels interlocked with securement panels which are attached to the lower edge of the lid side panel and have a locking slit therein, and having locking protrusions disposed on the upper edge of the locking panel, and an aperture means disposed in the polygonal top panel and supplementary polygonal top panels;

FIG. 3 is a further enlarged cross-sectional view taken along line 3—3 of FIG. 1 and showing the pair of supplementary polygonal top panels hingedly disposed on the polygonal top panel and further showing the locking engagement between the securement panel as hingedly connected to the lower edge of each lid side panel and having locking slits therein and the locking protrusion disposed at the upper edge of the locking panel for engaging the locking slit in the lid side panel;

FIG. 4 is also a further enlarged cross-sectional view taken along line 4—4 of FIG. 1, and showing the aperture means in the supplementary polygonal top panel and polygonal top panel for grasping the lid, center disposed fold line on the supplementary polygonal top panels upon itself and preferably under the polygonal top panel to form the triple thickness, and also showing the engagement between the securement panel slit and the locking protrusion of the locking panel;

Figure 5:
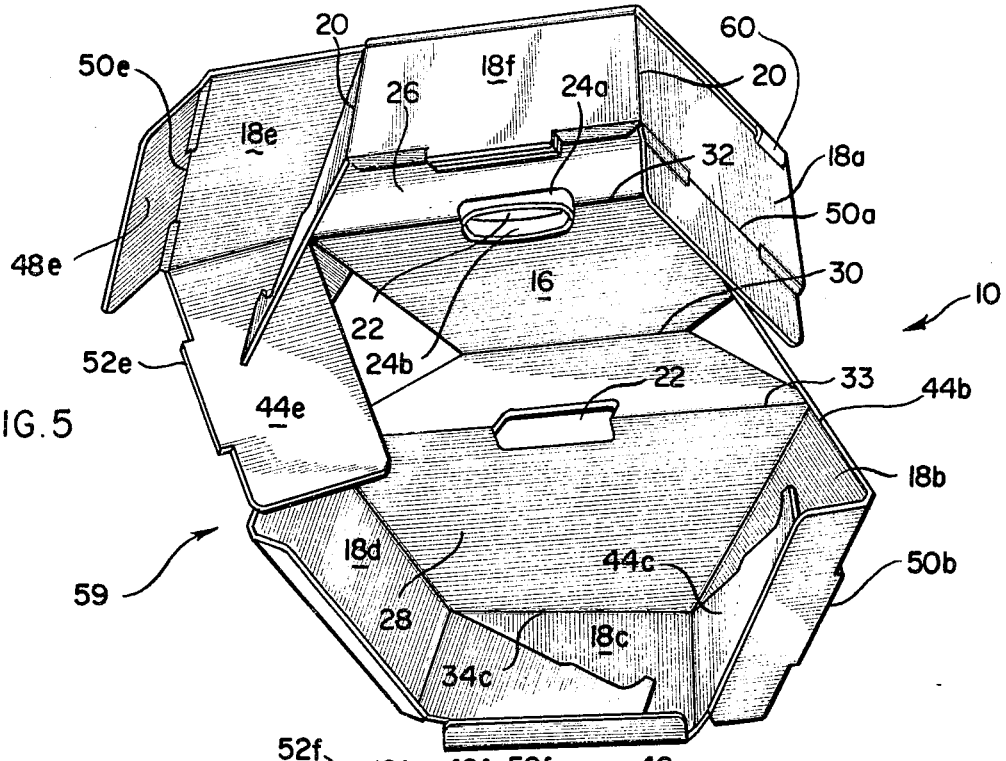
FIG. 5 is a perspective view of the above preferred embodiment of the lid for a polygonal container of the present invention in its partially folded disposition, from the underside thereof, and showing the polygonal top panel, the supplementary side panels, the plurality of lid side panels disposed from the supplementary top panels and and hingedly connected plurality of locking panels.

A plurality of locking panels each of which is hingedly connected to one opposed side of the corresponding lid side panel is provided. Each locking panel has an upper edge thereof which is generally congruent with the upper edge of the adjacent lid side panel when the lid side panels are in such folded disposition, and are thus disposed at approximately 90° to the polygonal top panel. Each locking panel has a mating locking means thereof for mating with the locking means on the corresponding adjacent side panel for engagement therebetween. The result is the securement of the lid side panels in such folded disposition at approximately 90° to the polygonal top panel to maintain thereby the opposed side edges of the lid side panel in substantially contacting relationship.

The side panel locking means preferably comprises a securement panel which is hingedly connected to the lower edge of each of the lid side panels and has a locking slit at the hinged connection therebetween. The mating locking means on the locking panel preferably comprises a locking protrusion disposed on the upper edge of the locking panel, and which locking protrusion corresponds in size and shape to the dimensions of the locking slit on the lid side panel hinged connection. When the panel locking means and mating locking means are in such folded disposition, the securement panel is folded approximately 180° around and over the corresponding locking panel for mating engagement of the locking protrusions with the locking slits to secure the side panels in such folded disposition. Preferably, at least one of the locking panels is generally triangular in shape. The securement panels are preferably generally rectangular in shape.

The preferred material for constuction of the lid for a polygonal container of the present invention is a rigid but foldable material, and preferably a corrugated material.

Each lid panel preferably has a single locking panel hingedly connected thereto, and each locking panel is preferably hingedly connected to its corresponding lid side panel at the same corresponding edge thereof, which results in projection of locking panels from the lid side panels in the same radial direction in each case. Preferably, the polygonal top panel further includes an aperture means therein for grasping the lid.

In an alternative preferred embodiment of the present invention, a pair of supplementary polygonal top panels are hingedly disposed from the polygonal top panel at opposing sides thereof. Each supplementary polygonal top panel has a fold line disposed generally across the middle thereof for reflectively folding the supplementary polygonal top panel. The result is that the supplementary polygonal top panels may be folded into contacting relationship with each other at the fold lines thereof and onto the polygonal top panel, to provide a triple thickness for covering the opening at the top of the polygonal container. The plurality of lid side panels may be hingedly disposed from supplementary polygonal top panels or part from the supplementary polygonal top panels and part from the centrally disposed polygonal top panel.

In such latter instance, the polygonal top panel is held in substantially contacting relationship to the supplementary polygonal top panels for greater strength and stability of the lid for a polygonal container of the present invention. In such embodiment, preferably the polygonal top panel and the supplementary polygonal top panels contain congruent aperture means when the lid is disposed in such folded disposition. Such aperture means preferably further include flange means thereon for locking engagement of the supplementary polygonal top panels and the polygonal top panel at such central portions thereof. It is also contemplated in such alternative preferred embodiment of the lid for a polygonal container of the present invention that tab means may be provided which are hingedly disposed from the polygonal top panel. Mating lid side panel openings may in such event be preferably provided for receiving such tab means when the lid is in such folded disposition to form a compact and stable structure.

In a further alternative preferred embodiment of the lid for a polygonal container of the present invention, the sides of the lid are insertable into the opening at the top of the polygonal container to provide a polygonal container having a side profile without lateral projections from the bottom to the top thereof. In such embodiments the supplementary polygonal top panels include first and second portions divided by a fold line. The first portion is disposed proximal of and is hingedly connected to a polygonal top panel and is substantially the same size and shape as the adjacent half of the polygonal top panel. The second portion of the supplementary polygonal top panel is disposed distally of the polygonal top panel and is substantially the same size as the adjacent half of the polygonal top panel, but is slightly smaller in dimensions to permit the side portions of the lid to be insertable into the opening at the top of the polygonal container upon folding of the lid.

In such further alternative embodiments, the lid for a polygonal container of the present invention may preferably have side panels which are hingedly connected at the upper edge thereof to the second portion of the supplementary polygonal top panels. In such embodiments each lid side panel when in the folded disposition is maintained at approximately 90° to the second portion of the supplemental polygonal top panel. Also in such alternative preferred embodiments, the lid side panels are disposed interior of the locking panels when in the folded disposition, such that the lid side portions are insertable into the opening at the top of a polygonal container for preferably snug interrelation.

In such embodiments, the side panel locking means present include a securement panel, as referred to above, which is hingedly connected to the lower edge of each of the lid side panels. Such securement panels have a proximally disposed locking slit in the lid side panel hinge connection, and a distally disposed free edge. The mating locking means on the locking panel includes a locking protrusion disposed on the upper edge of the locking panel and corresponds in size and shape to the locking slit disposed in the lid side panel hinge connection. The result is that, when the lid side panels are in the folded disposition, each of the locking protrusions matingly engages each of the locking slits.

In forming the lid for a polygonal container of the present invention in such alternative further preferred embodiments, the lid side panels may in some embodiments first be folded downwardly from the supplemental polygonal top panels; the corresponding locking panels then folded around, over and exterior to the lid side panels; and finally the securement panels folded upwardly and approximately 180° around, over and exterior of the corresponding locking panel to effect such mating engagement. Alternatively, the locking panels may be disposed interiorly of the side panels with the securement panels folded over and into the lid for interior disposition, as with other of the first described embodiments, supra. The result is a lid of such dimensions as to fit snugly within the opening at the top of the polygonal container.

In such further alternative preferred embodiments the polygonal container is formed from a plurality of hingedly connected rectangular side panels having a plurality of lid securement flaps disposed at the top edges thereof. The lid securement flaps of the polygonal container are folded downwardly and into the opening at the top of the polygonal container. Upon insertion of the lid of the present invention, in embodiments where the securement panels of the lid are exteriorly disposed there may be mating and locking engagement between the distally disposed free edges of the respective securement panels of the container with the lid securement flaps of the polygonal container sides. However, in embodiments where the securement panels are disposed interiorly, there is no such engagement with the polygonal container, which may be preferred for certain uses. In either case, the result of use of such further preferred alternative embodiments of the present invention is that the polygonal container has a smooth and unbroken profile along its sides from its top to its bottom, rather than having a container top projecting outwardly from the sides of the container near the top portion thereof, as with other embodiments described supra.

Referring now to the drawing and to FIG. 1 in particular, the lid of the present invention, shown generally at 10, is adapted for disposition atop a polygonal container 12 for covering the opening (not shown) in the top portion 14 thereof. Lid 10 for polygonal container 12 includes a polygonal top panel 16 with a plurality of lid side panels 18 *a–f* disposable normal thereto. The lid side panels 18 *a–f* are thus disposable downwardly at approximately 90° to polygonal top panel 16 to dispose the adjacent lid side panel edges 20 onto substantially contacting relationship. In such preferred embodiment, polygonal top panel 16 has an aperture 22 therein which aperture is bounded by flanges 24 *a–b* which are bent downwardly into aperture 22.

Figure 6:
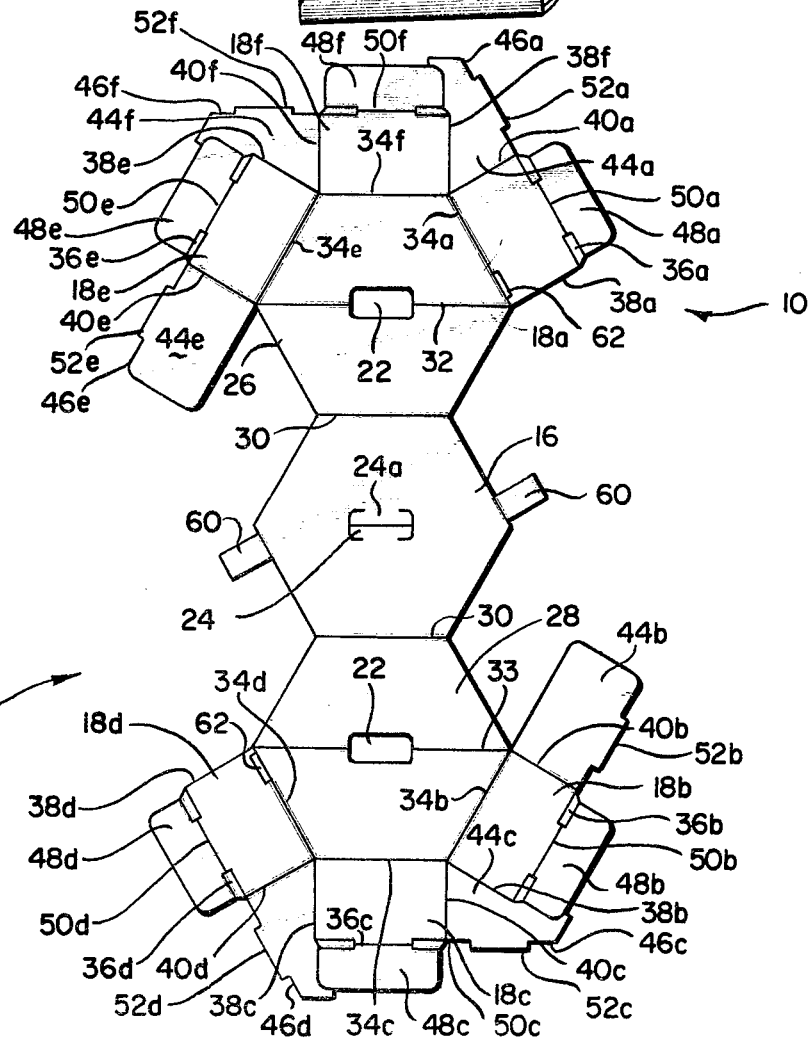
FIG. 6 is a plan view of the unitary blank for forming the lid for a polygonal container of the present invention, showing the centrally disposed polygonal top panel, the supplementary polygonal top panels disposed on opposite sides thereof, the apertures therein, the plurality of lid side panels disposed from the supplementary polygonal top panels, and the plurality of locking panels disposed from an opposed side of each of the lid side panels.

Referring now especially to FIG. 2 wherein lid 10 of the present invention is shown from a bottom perspective view, a pair of supplementary top panels 26, 28, and as shown in FIG. 6, are illustrated. Such supplementary top panels 26, 28 are hingedly connected at opposing sides 30 of polygonal top panel 16 to be hingedly disposed therefrom. Supplementary polygonal top panels 26, 28 contain fold lines 32, 33 respectively for reflectively folding supplementary top panels 26, 28 approximately 180° onto themselves and under polygonal top panel 16 to form a triple thickness top portion for the lid 10, as shown especially in FIG. 3. Flange means 24 defining aperture 22 in polygonal top panel 16 folded downwardly and inwardly to engage the reflectively folded layers of supplementary polygonal top panels 26, 28.

Figure 8:
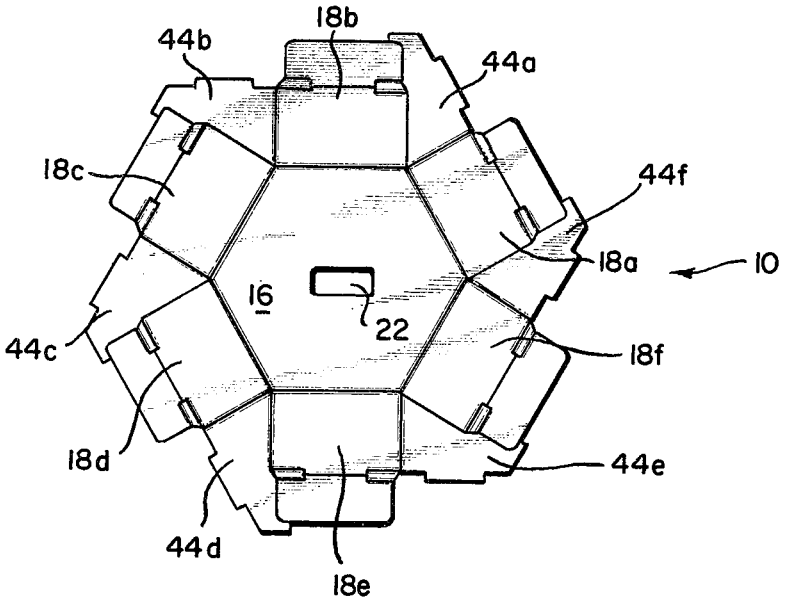
FIG. 8 is a plan view of a unitary blank of the lid for a polygonal container of the present invention in a further preferred embodiment thereof showing a single thickness top panel.
Figure 7:
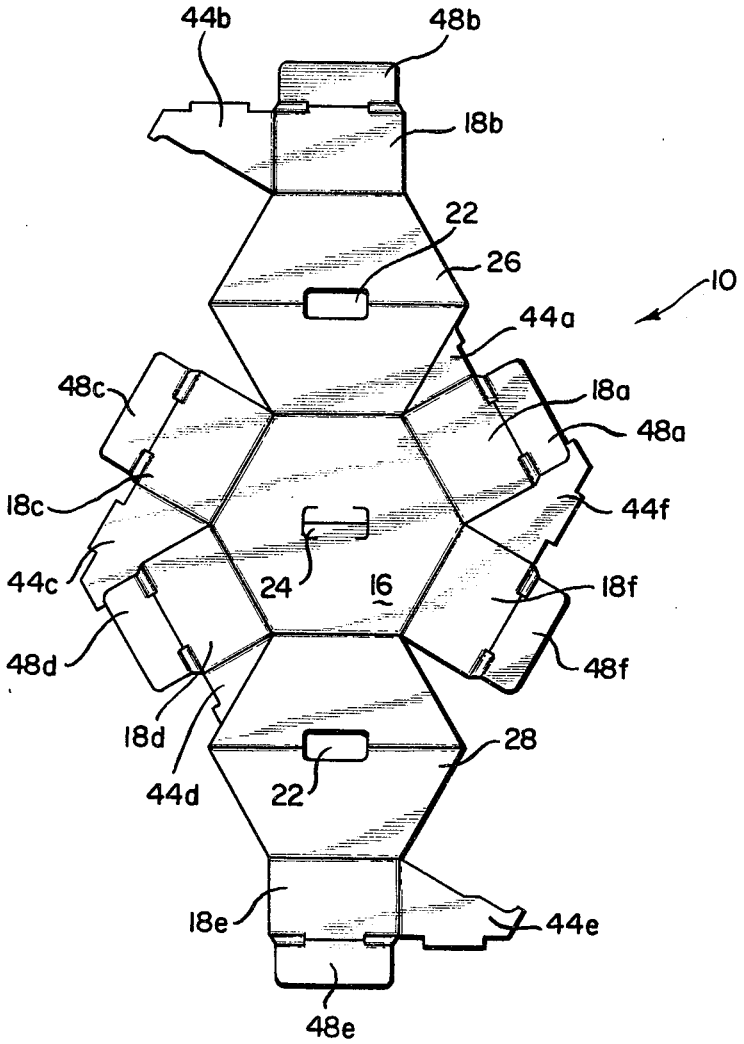
FIG. 7 is a plan view of an unitary blank of an alternative embodiment of the lid for a polygonal container of the present invention, wherein some of the plurality of lid side panels may be attached to the polygonal top panel, and some may be attached to the supplementary top panels.

Referring now to FIGS. 1–4 in particular, lid side panels 18 *a–f* are preferably rectangular in shape, and have oppositely disposed upper edges 34 *a–f* , lower edges 36 *a–f* and opposed side edges 38 *a–f* and 40 *a–f*. Each lid side panel 18 *a–f* is hingedly connected at the upper edge 34 *a–f* thereof to a polygonal side of supplementary polygonal top panels 26, 28, as shown in the embodiment of FIGS. 1–6, or to polygonal top panel 16 and to supplementary polygonal top panels 26, 28, as shown in FIG. 7, or to polygonal top panel 16 alone, as shown in FIG. 8.

Lid side panels 18 *a–f* are folded downwardly at approximately 90° to polygonal top panel 16 or to supplementary top panels 26, 28 to dispose adjacent lid side panels in substantially contacting relationship at the opposed sides thereof 20, as shown in the drawing. Each lid side panel 18 *a–f* has connected at one opposed side thereof, preferably 40 *a–f*, locking panel 44 *a–f*. Each locking panel 44 *a–f* has an upper edge 46 *a–f* which is generally congruent with upper edge 36 *a–f* of adjacent lid side panels 18 *a–f* respectively, when the lid is in the folded disposition, as shown in FIGS. 1–4. Lid side panels 18 *a–f* include a side panel locking means thereon which locking means is engaged with a mating locking means on locking panels 44 *a–f* to maintain the opposed side edges 20 of lid side panels 18 *a–f* in the substantially contacting relationship of the folded disposition. The side panel locking means preferably comprise securement panels 48 *a–f* which is hingedly connected to lower edge 36 *a–f* of each of lid side panel 18 *a–f*. Each securement panel 48 *a–f* has a locking slit 50 *a–f* disposed in the hinged connection therebetween. The mating locking means preferably includes respective locking protrusions 52 *a–f* which are disposed respectively on upper edges 46 *a–f* of locking panels 44 *a–f*, and which correspond in size and shape to locking slit 50 *a–f*. Thus, when lid side panels 18 *a–f* are in the folded disposition, securement panels 48 *a–f* are folded approximately 180° with respect to corresponding locking panel 44 *a–f* for mating engagement of locking protrusions 51 *a–f* with locking slits 50 *a–f* to secure lid side panels 18 *a–f* respectively in the folded disposition. That is shown in each of FIGS. 1–4.

The locking panels 44 *a–f* are preferably generally triangular in shape for the most part, as is shown in FIG. 6, although certain of locking panels, such as 44*b* and 44*d*, may be rectangular in shape, as is shown also in FIG. 6. In the embodiment of FIGS. 1–6, the locking panels thereof 44 *a–f* are hingedly connected to the corresponding lid side panel at the same corresponding edge 40 *a–f*, wherein each of the locking panels projects from the corresponding lid side panel 18 *a–f* in the same radial direction. In that case, lid side panel 18 *a–f* has a single locking panel hingedly connected thereto.

FIG. 5 shows folding of unitary blank generally 59 of FIG. 6 into the folded disposition, as seen in FIGS. 1–4. One lid side panel 18*f*, in the foreground, is shown lockingly engaging locking panel 44*a* of the adjacent lid side panel 18*a*. Moving in a counterclockwise direction, the next lid side panel 18*e* is shown folded outwardly and ready for engagement with locking panel 44*c* of lid side panel 18*a* by folding the securement panel 48*e* downwardly over the locking protrusion 52*f* of locking panel 44*f*. Locking panel 44*e* is shown disposed downwardly therefrom for engagement with the lid side panel 18*d*. Lid side panel 18*c* is shown in almost locking engagement with the locking panel 44*d*, as lid side panel 18*b* is with locking panel 44*c*. The lid side panel 18*a* and including its securement panel 48*e* downwardly over the locking protrusion 52*f* of locking panel 44*f*. Locking panel 44*e* is shown disposed downwardly therefrom for engagement with the lid side panel 18*d*. Lid side panel 18*c* is shown in almost locking engagement with the locking panel 44*d*, as lid side panel 18*b* with locking panel 44*c*. In the embodiment of FIG. 5, the first supplementary top panel 26 is shown in its reflectively folded disposition. The second supplementary top panel 28 is shown being folded along its fold line 33 into the reflectively folded position to form a top portion having a triple thickness.

In certain alternative embodiments tab 60 may be hingedly disposed on polygonal top panel 16 to be bent downwardly when lid 10 is in such folded disposition for engagement with openings 62 on corresponding lid side panels 18*a* and 18*d*, as shown in FIG. 6. The result is that polygonal top panel 16 is held firmly and in substantial proximity to supplementary polygonal top panels 26, 28 to form a compact and stable lid structure.

In the alternative preferred embodiment of FIG. 7, the elements thereof correspond in number and size generally to those of the preferred embodiment as described, supra. However, the difference therebetween lies in the fact that some of the lid side panels 18 *a–f* may be attached to polygonal top panel 16 and some to the supplementary polygonal top panels 26, 28. In one preferred embodiment, four of the lid side panels may be attached to the free end of each of the supplementary top panels 26, 28. In other preferred alternative embodiments, two lid side panels may alternatively be attached to each of polygonal top panel 16, first supplementary polygonal top panel 26, and second supplementary polygonal top panel 28.

In a further alternative preferred embodiment, as shown in FIG. 8, polygonal top panel 16 may have the lid side panels 18 *a–f* connected at the polygonal sides thereof, with the locking panels 44 *a–f* extending around radially from one opposed side only of each of the lid side panels 18 *a–f*.

FIGS. 9–14 illustrate further preferred embodiments of the lid for a polygonal container of the present invention. In these embodiments, as contrasted from the embodiments of FIGS. 1–8, supra, the side portions of the lid are insertable into the opening at the top of the polygonal container. This permits a smooth unbroken side profile for such polygonal containers, rather than having the side portions of the lid project exterior of the sides of the polygonal container as in the above embodiments of FIGS. 1–8.

Figure 9:
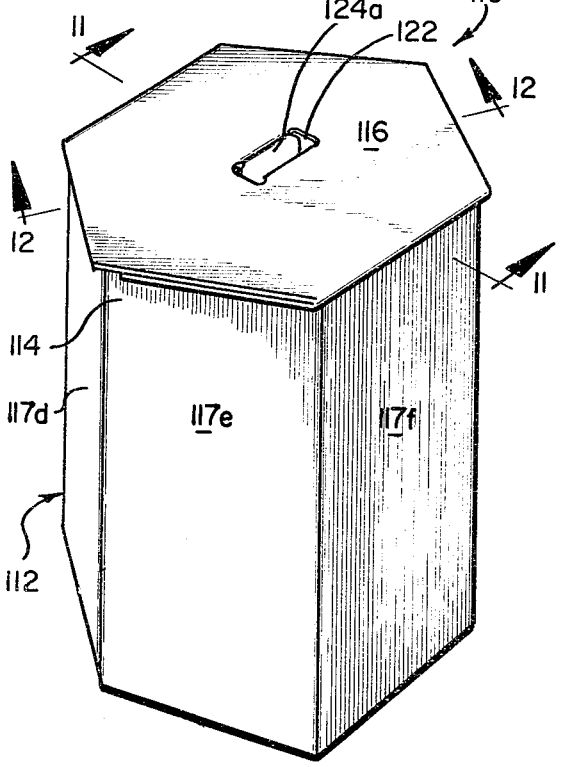
FIG. 9 is a perspective view of a further preferred embodiment of the lid for a polygonal container of the present invention showing such lid disposed atop and having its sides disposed into a polygonal container.
Figure 10:
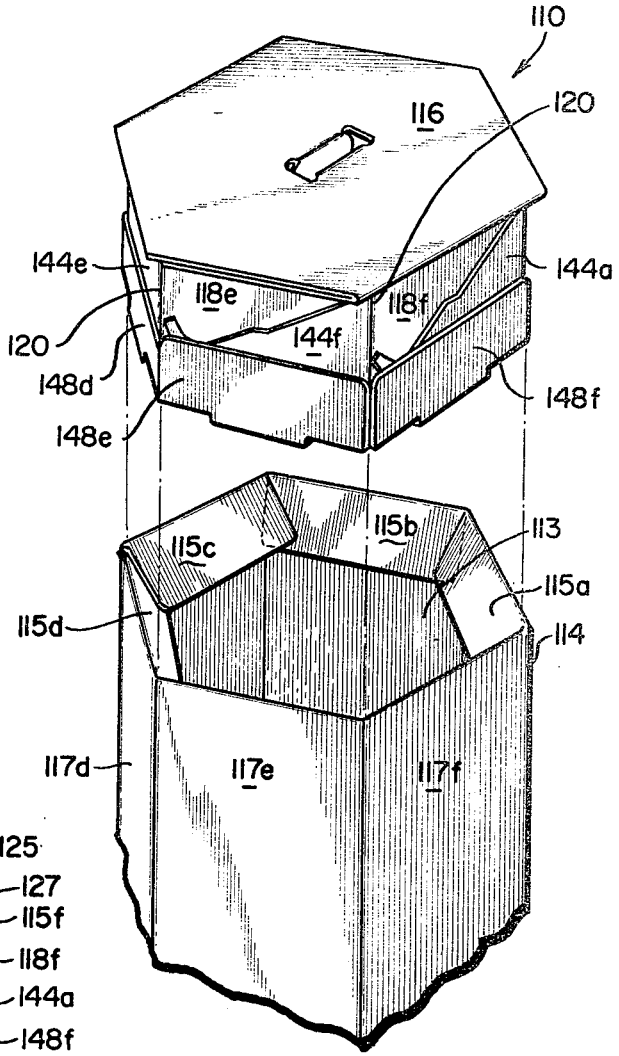
FIG. 10 is an exploded, fragmented perspective view of the embodiment of FIG. 9 of the lid for a polygonal container of the present invention, showing the polygonal container for use with such polygonal container having a plurality of rectangular side panels with a plurality of lid securement flaps disposed at the top edges thereof and folded inwardly and downwardly into the opening of the box, and further showing the insertable lid of the present invention wherein the securement panels of the lid are disposed exterior of the lid locking panels which are exposed at the exterior of the lid side panels.
Figure 11:
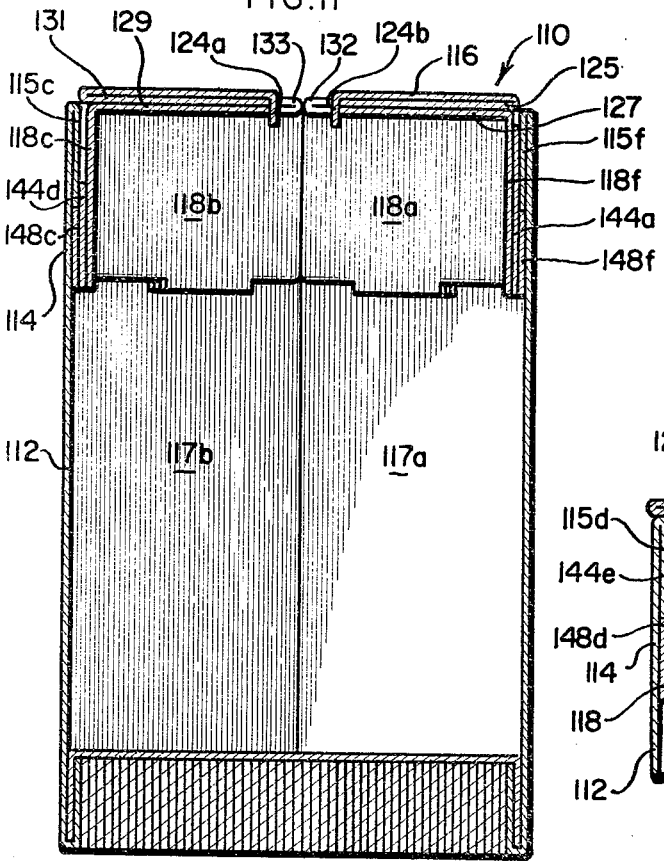
FIG. 11 is a cross-sectional view taken along the lines 11—11 of FIG. 9, and shows the polygonal container having a reinforced bottom and having a plurality of rectangular side panels, with the lid for a polygonal container of the present invention inserted into the opening at the top thereof to engage the lid securement flaps of the polygonal container.

Referring now to FIGS. 9–10 in particular, an alternative preferred embodiment of the lid of the present invention, shown generally at 110, is adapted for disposition atop a polygonal container generally 112 for covering the opening 113 in the top portion 114 thereof, such polygonal container having lid securement flaps 115 hingedly connected to the upper edges of polygonal container rectangular side panels 117 *a–f*, and folded downwardly and interiorly thereof. Lid 110 for polygonal container 112 includes a polygonal top panel 116 with a plurality of lid side panels 118 *a–f* disposable normal thereto. The lid side panels 118 *a–f* are thus disposable downwardly at approximately 90° to polygonal top panel 116 to dispose the adjacent lid side panel edges 120 onto substantially contacting relationship. In such preferred embodiments, polygonal top panel 116 has an aperture 122 therein which aperture is bounded by flanges 124 *a–b* which are bent downwardly into aperture 122.

Figure 14:
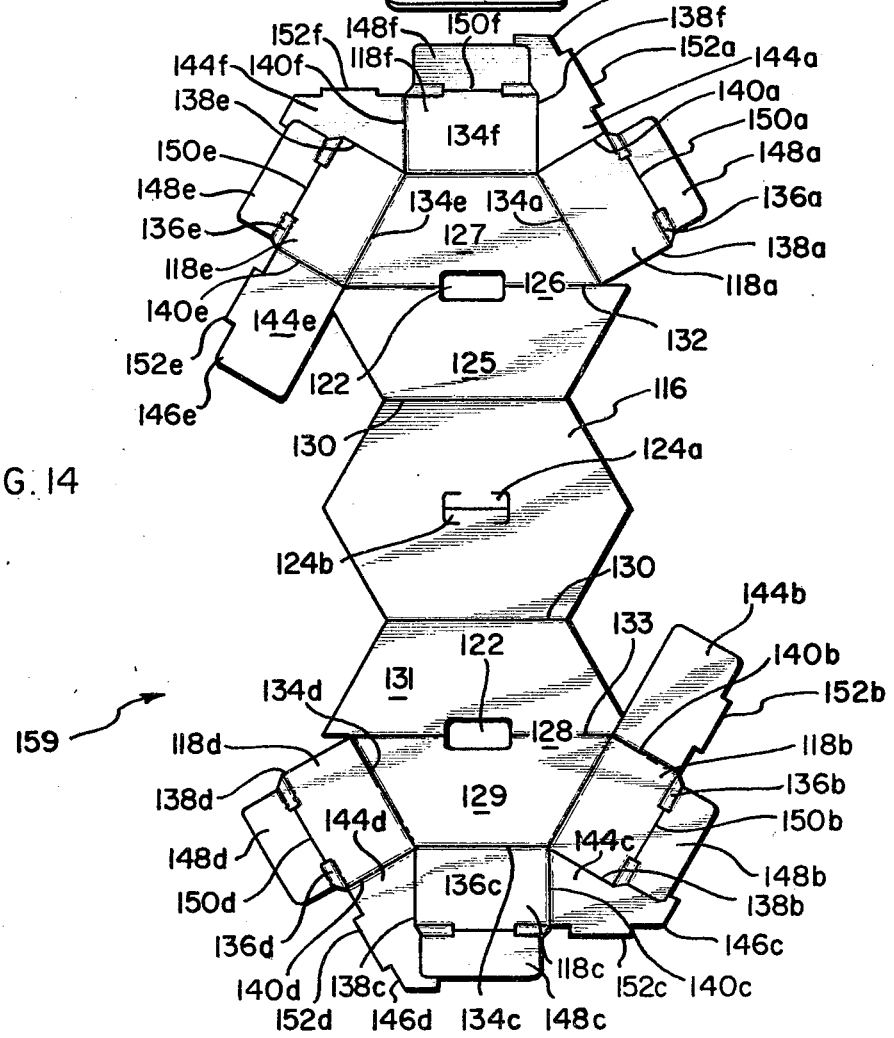
FIG. 14 is a plan view of the unitary blank for forming the lid shown in FIG. 9 for a polygonal container of the present invention.

A pair of supplementary top panels 126, 128 are illustrated particularly in the unitary block shown in FIG. 14. Such supplementary top panels 126, 128 are hingedly connected at opposing sides 130 of polygonal top panel 16 to be hingedly disposed therefrom. Supplementary polygonal top panels 126, 128 contain fold lines 132, 133 respectively as shown also in FIG. 11 for reflectively folding supplementary top panels 126, 128 approximately 180° onto themselves and under polygonal top panel 116 to form a triple thickness top portion for the lid 110, as shown especially in FIGS. 11 and 12. Flange means 124 defining aperture 122 in polygonal top panel 116 are folded downwardly and inwardly to engage the reflectively folded layers of supplementary polygonal top panels 126, 128 as shown particularly in FIG. 11.

Supplemental polygonal top panel 126 is divided by fold line 132 into a proximal portion 125 and a distal portion 127. Supplemental polygonal top panel 128 is divided by fold line 133 into a proximal portion 131 and a distal portion 129. Each of proximal portions 125, 131 is the same shape and size and is disposed in mirror image to the adjoining one half of polygonal top panel 116. Contrastingly, each of distal portions 127, 129 is of the same shape as one half of polygonal top panel 116, but is smaller in size for reasons which will become apparent, infra.

Figure 12:
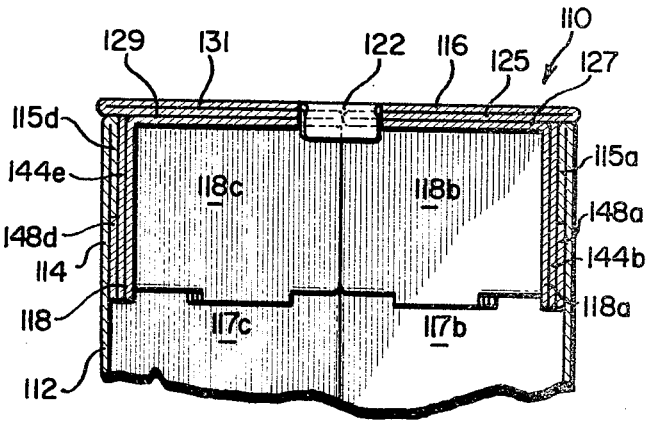
FIG. 12 is an enlarged, fragmented cross-sectional view taken along line 12—12 of FIG. 9, and shows top panel being of substantially the same size and shape as the top of the polygonal container to be covered. A plurality of preferably rectangular side panels, the same in number as the number of sides of the polygonal container, are hingedly connected at the upper edge thereof to a polygonal side of the polygonal top panel. Each lid side panel is adapted for folded disposition downwardly at approximately 90° to the polygonal top panel to dispose adjacent lid side panels in substantially contacting relationship at the opposed sides thereof, when the lid of the present invention is in such folded disposition. Each lid side panel preferably has side panel locking means thereon for maintaining the lid side panels in such folded disposition.

Referring now to FIGS. 12 and 14 in particular, lid side panels 118 *a–f* are preferably rectangular in shape, and have oppositely disposed upper edges 134 *a–f*, lower edges 136 *a–f* and opposed side edges 138 *a–f* and 140 *a–f*. Each lid side panel 118 *a–f* is hingedly connected at the upper edge 134 *a–f* thereof to a polygonal side of distal portions 127, 129 of supplementary polygonal top panels 126, 128 respectively.

Figure 13:
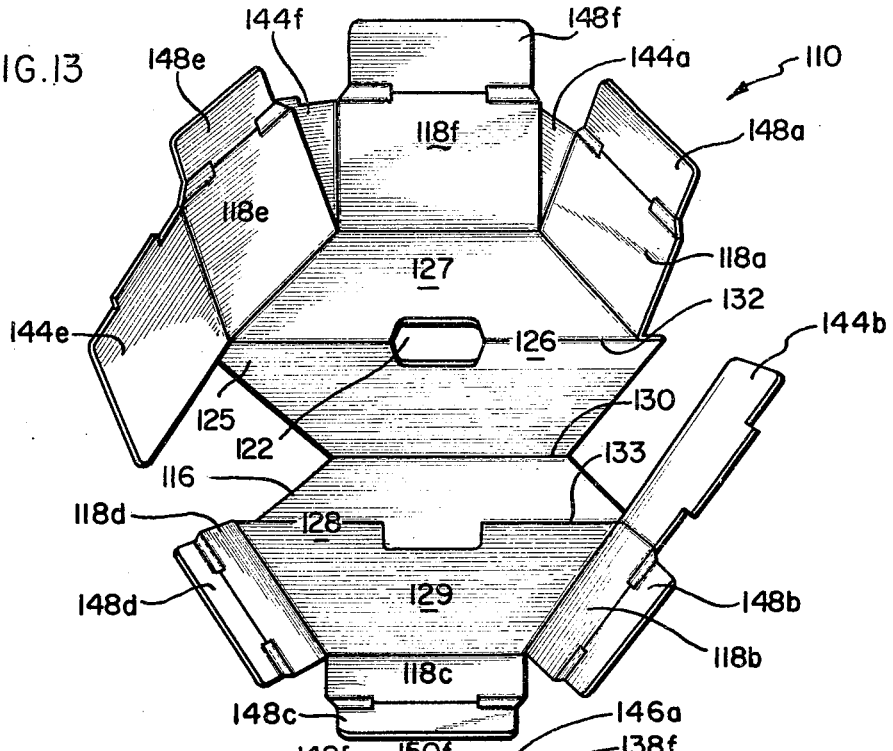
FIG. 13 is a perspective view of the blank of FIG. 9 in a partially erected disposition.

As shown particularly in the stages of folding represented from the flat blank of FIG. 14, to the partially folded blank of FIG. 13, to the completely folded lid of FIG. 10, lid side panels 118 *a–f* are folded downwardly at approximately 90° to supplementary top panels 126, 128 to dispose adjacent lid side panels in substantially contacting relationship at the opposed sides thereof 120, as shown in the drawing. Each lid side panel 118 *a–f* has connected at one opposed side thereof, preferably 140 *a–f*, a locking panel 144 *a–f*. Each locking panel 144 *a–f* has an upper edge 146 *a–f* which is generally congruent with upper edge 136 *a–f* of adjacent lid side panels 118 *a–f* respectively, when the lid is in the folded disposition, as shown in FIG. 10. Lid side panels 118 *a–f* include a side panel locking means thereon which locking means is engaged with a mating locking means on locking panels 144 *a–f* to maintain the opposed side edges 120 of lid side panels 118 *a–f* in the substantially contacting relationship of the folded disposition. The side panel locking means preferably comprise securement panels 148 *a–f* which is hingedly connected to lower edge 136 *a–f* of each of lid side panel 118 *a–f*. Each securement panel 148 *a–f* has a locking slit 150 *a–f* disposed in the hinged connection therebetween. The mating locking means preferably includes respective locking protrusions 152 *a–f* which are disposed respectively on upper edges 146 *a–f* of locking panels 144 *a–f*, and which correspond in size and shape to locking slit 150 *a–f*. Thus, when lid side panels 118 *a–f* are in the folded disposition of FIG. 10, each locking protrusion 152 *a–f* matingly engages each locking slit 150 *a–f*. Thus, in the folded disposition, securement panels 148 *a–f* are folded approximately 180° with respect to corresponding locking panel 144 *a–f* for mating engagement of locking protrusions 152 *a–f* with locking slits 150 *a–f* to secure lid side panels 118 *a–f* respectively in the folded disposition as shown in each of FIGS. 9–12.

The locking panels 144 *a–f* are preferably generally triangular in shape for the most part, as is shown in FIG. 14, although certain of locking panels, such as 144*b* and 144*d*, may be rectangular in shape, as is shown also in FIG. 14. In the embodiment of FIGS. 9–14, the locking panels thereof 144 *a–f* are hingedly connected to the corresponding lid side panel at the same corresponding edge 140 *a–f*, wherein each of the locking panels projects from the corresponding lid side panel 118 *a–f* in the same radial direction. In that case, each lid side panel 118 *a–f* has a single locking panel hingedly connected thereto.

FIG. 13 shows folding of unitary blank generally 159, of FIG. 14 into the folded disposition, as seen in FIGS. 9–12. Such folding may proceed as shown in the description of FIG. 5, supra. Alternatively, as shown in FIG. 13, each of lid side panels 118 *a–f* is folded downwardly at approximately 90° to the plane of polygonal top panel 116. Next, each of locking panels 144 *a–f* is disposed exterior of the corresponding lid side panels 118 *a–f*. Finally, each of securement panels 148 *a–f* is folded upwardly at approximately 180° exterior of the locking panels 144 *a–f* to engage the respective locking protrusions 152 *a–f* on locking panels 144 *a–f* with the respective locking slits 150 *a–f* of the lid side panels 118 *a–f*. The result is that the securement panels 148 *a–f* project upwardly on the respective exterior surface of the sides of the lid. Because each of the distal portions 127, 129 of supplementary polygonal top panels 126, 128 is of a slightly smaller size than polygonal top panel 116, and the lid side panels 118 *a–f* extend downwardly therefrom, the resulting lid 110 is of an appropriate size to fit snugly within polygonal container 112.

The material preferably utilized is a rigid but foldable material. One material which has proved to be notably successful has been corrugated material.

The basic and novel characteristics of the lid for a polygonal container of the present invention will be readily understood from the foregoing disclosure by those skilled in the art. It will become readily apparent that various changes and modifications may be made in the form, construction and arrangement of the lid for a polygonal container of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. A lid for a polygonal container which polygonal container has an opening at the top thereof and a selected number of sides defining the opening, said lid comprising:

a polygonal top panel having a number of polygonal sides which number is the same as the selected number of sides of the polygonal container, said polygonal top panel being of such size and shape as to correspond substantially to the size and shape of the opening at the top of the polygonal container;

a plurality of lid side panels being the same in number as the selected number of sides of the polygonal container, each said lid side panel being generally rectangular in shape and having oppositely disposed upper and lower edges and opposed side edges, and each said lid side panel being hingedly connected at the upper edge thereof to a polygonal side of said polygonal top panel, each said lid side panel being adapted for folded disposition downwardly at approximately 90° to said polygonal top panel to dispose adjacent said lid side panels in substantially contacting relationship at the opposed sides thereof when in such folded disposition at approximately 90° to said polygonal top panel, and each said lid side panel having side panel locking means thereon for maintaining said lid side panels in said folded disposition; and a plurality of locking panels, each of which is hingedly connected to one said opposed side of each said lid side panel, each said locking panel having an upper edge which is generally congruent with the upper edge of the adjacent said lid side panel when said plurality of lid side panels are in said folded disposition at approximately 90° to said polygonal top panel, each said locking panel having a mating locking means thereon for mating with said locking means on said corresponding adjacent said side panel for engaging therewith to secure said lid side panels in said folded disposition at approximately 90° to said polygonal top panel and to maintain said opposed side edges of said lid side panels in said substantially contacting relationship, whereby a lid having a securely fixed polygonal top panel and lid side panels for generally fitting over and closing the open end of the polygonal container is attained.

2. The lid for a polygonal container as claimed in claim 1 wherein:

said side panel locking means comprises a securement panel hingedly connected to said lower edge of each said lid side panel and having a locking slit in said lid side panel hinged connection; and wherein said mating locking means on said locking panel comprises a locking protrusion disposed on said upper edge of said locking panel corresponding in size and shape to said locking slit in said lid side panel hinged connection, whereby, when said lid side panels are in said folded disposition, each said locking protrusion matingly engages each said locking slit.

3. The lid for a polygonal container as claimed in claim 2 wherein said securement panel is folded approximately 180° around and over said corresponding locking panel for mating engagement of said locking protrusions with said locking slits to secure said lid side panels in said folded disposition.

4. The lid for a polygonal container as claimed in claim 1 wherein at least one of said locking panels is generally triangular in shape.

5. The lid for a polygonal container as claimed in claim 2 wherein said securement panels are generally rectangular in shape.

6. The lid for a polygonal container as claimed in claim 1 wherein said lid is formed from a unitary blank of rigid and foldable material.

7. The lid for a polygonal container as claimed in claim 6 wherein said rigid and foldable material comprises a corrugated material.

8. The lid for a polygonal container as claimed in claim 1 wherein each said lid side panel has a single said locking panel hingedly connected thereto.

9. The lid for a polygonal container as claimed in claim 8 wherein each said locking panel is hingedly connected to its corresponding lid side panel at the same corresponding edge wherein each said locking panel projects therefrom in the same radial direction.

10. The lid for a polygonal container as claimed in claim 1 wherein said polygonal top panel includes aperture means therein for grasping said lid.

11. A lid for a polygonal container which polygonal container has an opening at the top thereof and a selected number of sides defining the opening, said lid comprising:

a polygonal top panel having a number of polygonal sides which number is the same as the selected number of sides of the polygonal container, said polygonal top panel being of such size and shape as to correspond substantially to the size and shape of the opening at the top of the polygonal container;

a pair of supplementary polygonal top panels hingedly disposed from said polygonal top panel at opposing sides thereof, each said supplementary polygonal top panel having a fold line thereon for reflectively folding said supplementary polygonal top panels, whereby said supplementary polygonal top panels may be folded into contacting relationship with and onto said polygonal top panel and said supplementary polygonal top panels may be reflectively folded to provide a triple thickness for covering the opening at the top of the polygonal container;

a plurality of lid side panels being the same in number as the selected number of sides of the polygonal container, each said lid side panel being generally rectangular in shape and having oppositely disposed upper and lower edges and opposed side edges, and each said lid side panel being hingedly connected at the upper edge thereof to at least one of said polygonal top panel and said supplementary polygonal top panels, and each said lid side panel being adapted for folded disposition downwardly at approximately 90° to said polygonal top panel, each said lid side panel having side panel locking means thereon for maintaining said lid side panels in said folded disposition; and a plurality of locking panels, each of which is hingedly connected to one said opposed side of each said lid side panel, each said locking panel having an upper edge which is generally congruent with the upper edge of the adjacent said lid side panel when said plurality of lid side panels are in said folded disposition at approximately 90° to at least one of said polygonal top panel and said supplementary polygonal top panels, each said locking panel having a mating locking means thereon for mating with said locking means on said corresponding adjacent said side panel for engaging therewith to secure said lid side panels in said folded disposition at approximately 90° to at least one of said polygonal top panel and said supplementary polygonal top panels, and to maintain said opposed side edges of said lid side panels in said substantially contacting relationship, whereby a lid having a securely fixed polygonal top panel and lid side panels for generally fitting over and closing the open end of the polygonal container is attained.

12. The lid for a polygonal container as claimed in claim 11 wherein said lid side panels are hingedly disposed from said supplementary top panels.

13. The lid for a polygonal container as claimed in claim 11 wherein said polygonal top panel and said supplementary polygonal top panels include congruent aperture means when in said folded disposition for grasping said lid.

14. The lid for a polygonal container as claimed in claim 13 further comprising flange means disposed on said aperture means for locking by engaging said supplementary polygonal top panels and said polygonal top panel when said lid side panels are in folded disposition.

15. The lid for a polygonal container as claimed in claim 11 further comprising tab means hingedly disposed from said polygonal top panel and wherein said lid side panels contain openings therein for receiving said tab means when in said folded disposition, whereby said polygonal top panel is securely held in substantial proximity to said supplementary polygonal top panels to form a compact and stabile lid structure.

16. The lid for a polygonal container as claimed in claim 11 wherein:

said side panel locking means comprises a securement panel hingedly connected to said lower edge of each said lid side panel and having a locking slit in said lid side panel hinged connection; and wherein said mating locking means on said locking panel comprises a locking protrusion disposed on said upper edge of said locking panel corresponding in size and shape to said locking slit in said lid side panel hinged connection, whereby, when said lid side panels are in said folded disposition, each said locking protrusion matingly engages each said locking slit.

17. The lid for a polygonal container as claimed in claim 16 wherein said securement panel is folded approximately 180° around and over said corresponding locking panel for mating engagement of said locking protrusions with said locking slits to secure said lid side panels in said folded disposition.

18. The lid for a polygonal container as claimed in claim 11 wherein at least one of said locking panels is generally triangular in shape.

19. The lid for a polygonal container as claimed in claim 11 wherein said securement panels are generally rectangular in shape.

20. The lid for a polygonal container as claimed in claim 11 wherein said lid is formed from a unitary blank of rigid and foldable material.

21. The lid for a polygonal container as claimed in claim 20 wherein said rigid and foldable material comprises a corrugated material.

22. The lid for a polygonal container as claimed in claim 11 wherein each said lid side panel has a single said locking panel hingedly connected thereto.

23. The lid for a polygonal container as claimed in claim 22 wherein each said locking panel is hingedly connected to its corresponding lid side panel at the same corresponding edge and wherein each said locking panel projects therefrom in the same radial direction.

24. The lid for a polygonal container as claimed in claim 11 wherein said polygonal top panel includes aperture means therein for grasping said lid.

25. The lid for a polygonal container as claimed in claim 11 wherein said supplementary polygonal top panels comprise first and second portions divided by said fold line, said first portion disposed proximal of and hingedly connected to said polygonal top panel and being substantially the same size and shape as the adjacent half of said polygonal top panel, said second portion disposed distally of said polygonal top panel and being substantially the same shape as the adjacent half of said polygonal top panel but slightly smaller in dimensions.

26. The lid for a polygonal container as claimed in claim 25 wherein each said lid side panel is hingedly connected at the upper edge thereof to said second portion of said supplementary polygonal top panels.

27. The lid for a polygonal container as claimed in claim 25 wherein each said lid side panel when in said folded disposition is maintained at approximately 90° to said second portion of said supplementary polygonal top panels.

28. The lid for a polygonal container as claimed in claim 25 wherein said lid side panels are disposed interior of said locking panels when in said folded disposition, whereby a lid having lid side panels for generally fitting into and within and closing the opening at the top of the polygonal container is attained.

29. The lid for a polygonal container as claimed in claim 25 wherein said polygonal top panel and said supplementary polygonal top panels include congruent aperture means when in said folded disposition for grasping said lid.

30. The lid for a polygonal container as claimed in claim 29 further comprising flange means disposed on said aperture means for locking by engaging said supplementary polygonal top panels and said polygonal top panel when said lid side panels are in said folded disposition.

31. The lid for a polygonal container as claimed in claim 25 wherein:

said side panel locking means comprises a securement panel hingedly connected to said lower edge of each said lid side panel, having a proximally disposed locking slit in said lid side panel hinged connection and a distally disposed free edge; and wherein said mating locking means on said locking panel comprises:

a locking protrusion disposed on said upper edge of said locking panel corresponding in size and shape to said locking slit in said lid side panel hinged connection, whereby, when said lid side panels are in said folded disposition, each said locking protrusion matingly engages each said locking slit.

32. The lid for a polygonal container as claimed in claim 25 wherein said securement panel is folded approximately 180° around, over and exterior of said corresponding locking panel for mating engagement of said locking protrusions with said locking slits to secure said lid side panels in said folded disposition.

33. The lid for a polygonal container as claimed in claim 32 wherein said polygonal container sides are formed from a plurality of hingedly connected rectangular side panels having a plurality of lid securement flaps disposed at the top edges thereof, said lid securement flaps are folded downwardly into the opening at the top of the polygonal container for mating and locking engagement with said distally disposed free edges of said respective securement panels.

34. The lid for a polygonal container as claimed in claim 25 wherein at least one of said locking panels is generally triangular in shape.

35. The lid for a polygonal container as claimed in claim 25 wherein said securement panels are generally rectangular in shape.

36. The lid for a polygonal container as claimed in claim 25 wherein said lid is formed from a unitary blank of rigid and foldable material.

37. The lid for a polygonal container as claimed in claim 25 wherein said rigid and foldable material comprises a corrugated material.

38. The lid for a polygonal container as claimed in claim 25 wherein each said lid panel has a single said locking panel hingedly connected thereto.

39. The lid for a polygonal container as claimed in claim 25 wherein each said locking panel is hingedly connected to its corresponding lid side panel at the same corresponding edge and wherein each said locking panel projects therefrom in the same radial direction.

* * * * *